US011765509B1

(12) United States Patent
Boyd

(10) Patent No.: US 11,765,509 B1
(45) Date of Patent: Sep. 19, 2023

(54) MEMS DEVICE AND ELECTRO-ACOUSTIC TRANSDUCER

(71) Applicant: AAC ACOUSTIC TECHNOLOGIES (SHENZHEN) CO., LTD., Shenzhen (CN)

(72) Inventor: Euan James Boyd, EB (GB)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/826,179

(22) Filed: May 27, 2022

(51) Int. Cl.
*H04R 1/08* (2006.01)
*H04R 7/06* (2006.01)
*H04R 7/16* (2006.01)

(52) U.S. Cl.
CPC ..... *H04R 7/06* (2013.01); *H04R 1/08* (2013.01); *H04R 7/16* (2013.01); *H04R 2201/003* (2013.01); *H04R 2410/03* (2013.01)

(58) Field of Classification Search
CPC ... H04R 1/08; H04R 7/06; H04R 7/16; H04R 2201/003
See application file for complete search history.

(56) References Cited

U.S. PATENT DOCUMENTS 8,624,385 B1 * 1/2014 Minervini ..... B81B 7/0058 29/594
2016/0286317 A1 * 9/2016 Zhao ..... H04R 7/08
2020/0077202 A1 * 3/2020 Kamijima ..... H04R 19/04
2020/0322732 A1 * 10/2020 Lee ..... H04R 31/00

* cited by examiner

*Primary Examiner* — Suhan Ni
(74) *Attorney, Agent, or Firm* — W&G Law Group

(57) ABSTRACT

Provided is an MEMS device, including: a substrate having back cavity passing thererthrough; a diaphragm connected to the substrate and covers the back cavity, the diaphragm includes first and second membranes, and accommodating space formed therebetween; a counter electrode; and support loop members arranged concentrically. Opposite ends of the support loop member are connected to the first and second membranes. The support loop members are arranged at intervals. Each support loop member has first sections concentrically arranged as a loop member at intervals. A first notch is formed between two adjacent first sections. In at least one support loop member, the first section has second sections concentrically arranged as a loop member at intervals. A second notch is formed between two adjacent second sections. By a larger first section, distance between adjacent first sections is larger, the technical problem that large number of slots required for counter electrode is solved.

11 Claims, 4 Drawing Sheets

MEMS DEVICE AND ELECTRO-ACOUSTIC TRANSDUCER

TECHNICAL FIELD

The present disclosure relates to the technical field of micro-electromechanical systems, in particular to an MEMS device and an electro-acoustic transducer.

BACKGROUND

In the related art, a microphone with a double-membrane structure has been developed and produced. The microphone has two membranes arranged on opposite sides of a counter electrode. As a result, a sealed accommodating space is formed between the two membranes, which can have a different pressure compared to the external environment. If the pressure in the accommodating space is reduced, this structure will significantly reduce the self-noise (the main noise source in Micro Electro Mechanical System (MEMS) microphones) associated with the counter electrode.

The two membranes in the related art are connected together by a number of small circular pillars to prevent the structure from collapsing. In order to prevent the membrane from excessively deforming under atmospheric pressure, adjacent small circular pillars need to be closely spaced from each other with a distance of about 5-20 um.

Since small circular pillars shall pass through the counter electrode without contacting each other, each small circular pillar needs to correspond to slots in the counter electrode. Small circular pillars that are excessively close to each other will reduce the reliability of the counter electrode and bring design limits to acoustic damping and capacitance of the microphone.

SUMMARY

The purpose of the present disclosure is to provide an MEMS device and an electro-acoustic transducer to solve the technical problems in the related art.

The present disclosure provides an MEMS device, including: a substrate having a back cavity passing through the substrate; a diaphragm connected to the substrate and covers the back cavity, the diaphragm includes a first membrane and a second membrane arranged opposite to each other, and an accommodating space is formed between the first membrane and the second membrane; a counter electrode arranged in the accommodating space; and a plurality of support loop members arranged concentrically in the accommodating space. Opposite ends of each of the plurality of support loop members along a vibration direction are respectively connected to the first membrane and the second membrane. The plurality of support loop members are arranged at intervals along a radial direction of the diaphragm with a center of the diaphragm as the center. Each of the plurality of support loop members is composed of a plurality of first sections concentrically arranged, the plurality of first sections are arranged as a loop member at intervals. A first notch is formed between two adjacent first sections of the plurality of first sections. In at least one of the plurality of support loop members, the first section is composed of a plurality of second sections concentrically arranged, the plurality of second sections are arranged as a loop member at intervals. A second notch is formed between two adjacent second sections of the plurality of second sections.

As an improvement, in each of four support loop members of the plurality of support loop members close to an edge of the diaphragm, the first section is composed of a plurality of second sections arranged concentrically.

As an improvement, the first section is composed of two second sections arranged concentrically.

As an improvement, positions of the first notches in two adjacent support loop members of the plurality of support loop members are in a one-to-one correspondence, and arc lengths of the first notches in the plurality of support loop members increase along the radial direction of the diaphragm.

As an improvement, the first membrane includes a plurality of first protrusions protruding toward the accommodating space, and the second membrane includes a plurality of second protrusions protruding toward the accommodating space, the plurality of first protrusions and the plurality of second protrusions are arranged at intervals along the radial direction of the diaphragm. The plurality of support loop members, the plurality of first protrusions and the plurality of second protrusions are in one-to-one correspondence, and opposite ends of the support loop member are respectively connected to one of the plurality of first protrusions and one of the plurality of second protrusions.

As an improvement, the first membrane and the second membrane both have a planar structure.

As an improvement, the accommodating space is hermetically sealed, and an internal pressure of the accommodating space is less than an external atmospheric pressure.

As an improvement, the first membrane and the second membrane are both made of a conductive material or include an insulation film having a conductive element.

As an improvement, the counter electrode includes a single conductor, a first capacitor is formed between the first membrane and the single conductor, and a second capacitor is formed between the second membrane and the single conductor.

The present disclosure also provides an electro-acoustic transducer, which includes the aforementioned MEMS device and a circuit device electrically connected to the MEMS device.

Compared with the related art, one the one hand, the present disclosure adopts a number of support loop members to connect the first membrane and the second membrane. The support loop member is composed of first sections and first notches alternately arranged and spaced from each other. By adopting a larger first sections, the distance between adjacent first sections is larger, which solves the technical problem that a large number of slots needs to be provided in the counter electrode. On the other hand, in at least one support loop member, the first section is divided by the second notches into a plurality of second sections adjacent to each other, thereby improving the stiffness of the counter electrode.

REFERENCE SIGNS

10—substrate, 11—back cavity;
20—diaphragm, 21—first membrane, 211—first protrusion, 22—second membrane, 221—second protrusion, 23—accommodating space, 24—opening;
30—support loop member, 31—first section, 32—first notch, 33—second section, 34—second notch;
40—counter electrode;
100—electro-acoustic transducer;
200—MEMS components;
300—circuit device.

DESCRIPTION OF EMBODIMENTS

Embodiments of the present disclosure are described in detail below. Examples of the embodiments are shown in the accompanying drawings, in which the same or similar reference signs indicate the same or similar elements or elements with the same or similar functions. The embodiments described below with reference to the drawings are exemplary, and are only used to explain the present disclosure, and cannot be construed as limiting the present disclosure.

Figure 1:
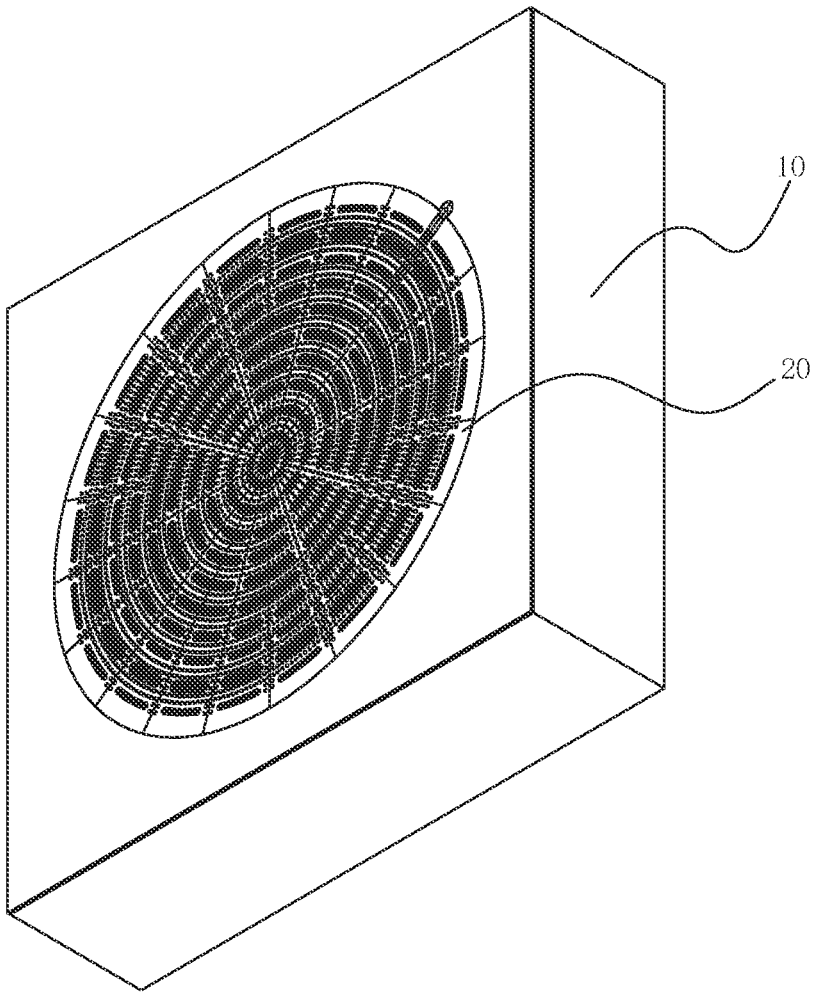
FIG. 1 is an isometric view of an MEMS device provided by the present disclosure.
Figure 2:
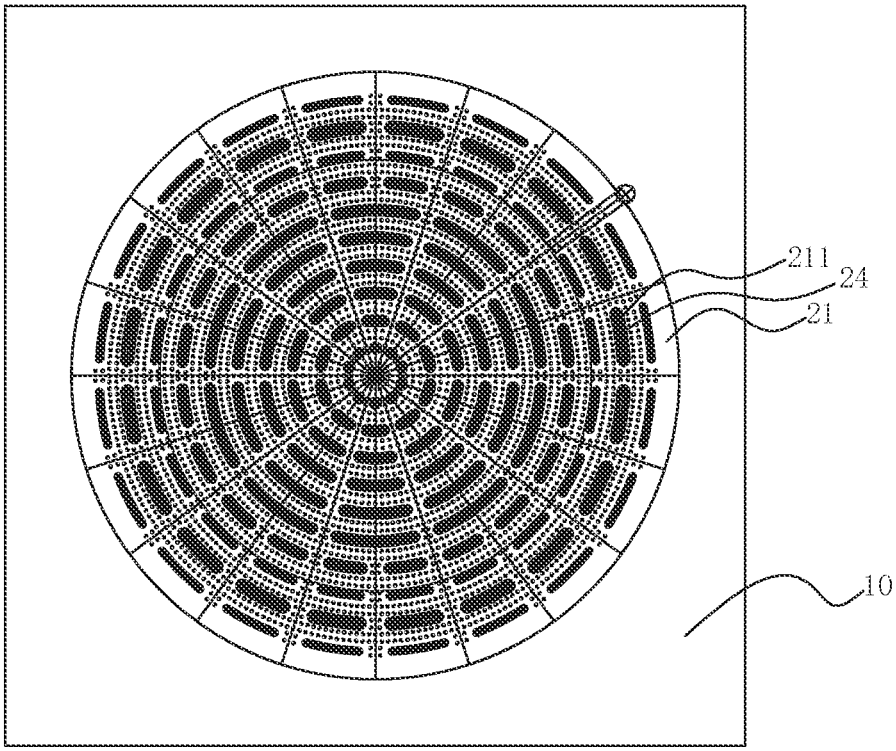
FIG. 2 is a top view of an MEMS device provided by the present disclosure.

As shown in FIG. 1 and FIG. 2, FIG. 1 is an isometric view of an MEMS device provided by the present disclosure, and FIG. 2 is a top view of an MEMS device provided by the present disclosure. An embodiment of the present disclosure provides an MEMS device 200, the MEMS device 200 includes a substrate 10, a diaphragm 20, a counter electrode 40, and a plurality of support loop members 30.

A back cavity 11 passes through the substrate 10. For example, the inner profile of the back cavity 11 is a circular opening structure.

The diaphragm 20 is connected to the substrate 10 and covers the back cavity 11. The diaphragm 20 includes a first membrane 21 and a second membrane 22 that are arranged opposite to each other. In this embodiment, the first membrane 21 and the second membrane 22 are concentrically arranged circular structures. A preset gap is formed between the first membrane 21 and the second membrane 22 to form an accommodating space 23. The first membrane 21 and the second membrane 22 may both be made of a conductive material, or they each include an insulation film having a conductive element.

The counter electrode 40 is arranged in the accommodating space 23 in a suspended state. In a normal state, there is no contact between the counter electrode 40 and the first membrane 21 and the second membrane 22, and there is no mechanical coupling between the counter electrode 40 and the support loop member 30.

In some embodiments, the counter electrode 40 includes a single conductor, so that a first capacitor is formed between the first membrane 21 and the single conductor, and a second capacitor is formed between the second membrane 22 and the single conductor. In response to the pressure applied to the first membrane 21 and the second membrane 22, the first membrane 21 and the second membrane 22 are movable relative to the corresponding counter electrode 40, thereby changing the distance between the first membrane 21 and the second membrane 22 with the corresponding counter electrode 40. As a result, the capacitance is changed to output an electrical signal accordingly.

Figure 3:
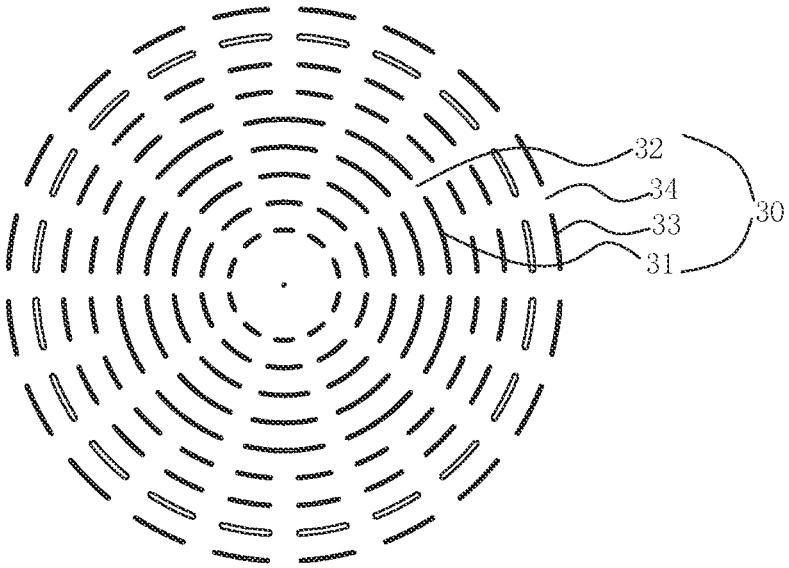
FIG. 3 is a schematic structural diagram of a support loop member provided by the present disclosure.

Referring to FIG. 3, FIG. 3 is a schematic structural diagram of a support loop member provided by the present disclosure. The plurality of support loop members 30 are preferably ring-shaped or annular structures, and the plurality of support loop members 30 are arranged concentrically in the accommodating space 23. It is appreciated that, in this context, the term "loop member" may refer to any member that forms a loop, for example a circular ring, a rounded square or rectangle or the like. The specific shape is not limited herein. Opposite ends of the plurality of support loop members 30 along a direction perpendicular to the diaphragm 20 are respectively connected to the first membrane 21 and the second membrane 22. The plurality of support loop members 30 are arranged at intervals along a radial direction of the diaphragm 20 with a center of the diaphragm 20 as the center. The farther the center of the diaphragm 20, the larger the inner diameter of the support loop member 30.

The function of the support loop member 30 is to keep the first membrane 21 and the second membrane 22 flat, or at least limit/control the bending/deformation of the first membrane 21 and the second membrane 22 between support loop members 30 to avoid the first membrane 21 and the second membrane 22 from being folded with each other when the sealed accommodating space 23 is under a reduced atmospheric pressure and the external environment is under an ambient atmospheric pressure.

The support loop member 30 may be an integral wall structure, or it may be provided with a cavity filled having a filler. The filler may be an oxide, such as silicon oxide. Alternatively, the cavity may be empty. Slots can also be provided in the cavity to allow air or an etching solution from the external environment to enter the cavity to release the filler, thereby increasing the compliance of the first membrane 21 and the second membrane 22 and, at the same time, reducing inter-plate capacitance between the first membrane 21 and the second membrane 22.

In some embodiments, both the first membrane 21 and the second membrane 22 are provided with an opening 24. Opposite openings 24 completely release the filler filled in the cavity of the support loop member 30. That is, a vent is formed penetrating through the first membrane 21 and the second membrane 22, so that the compliance of the membranes in the area where the opening 24 is located can be significantly improved. The openings 24 on the first membrane 21 and the second membrane 22 may have the same size and shape, or may be different from each other, which is not limited herein.

The support loop member 30 may be integrally formed with one of the first membrane 21 and the second membrane 22. Alternatively, after the first membrane 21 and the second membrane 22 are assembled together, a support loop member 30 is formed therebetween.

Each support loop member 30 is composed of a number of concentrically arranged first sections 31. Slots are provided on the counter electrode 40 corresponding to the first sections 31 for the support loop members 30 to pass through. A cross section of the section may have an arc shape. Alternatively, cross section of the section may have a straight-line shape, a zigzag shape or the like. The plurality of first sections 31 have the same inner diameter. The plurality of first sections 31 are arranged as a loop member at intervals. A first notch 32 is formed between adjacent first sections 31. Compared with the small circular pillars in the related art, the present disclosure adopts a larger first section 31 to support the first membrane 21 and the second membrane 22, so that the distance between the adjacent first sections 31 is larger. Therefore, the technical problem that a large number of through openings need to be provided in the counter electrode 40 is solved. The design of the counter electrode 40 is separated from the design of the support loop member 30, and the first section 31 is much larger than the small circular pillar in the related art, which makes the pillar structure having the same aspect ratio become much taller. Therefore, it is possible to use a thicker counter electrode 40, and allow for a more stiff structure, which can significantly improve the stability and reliability of the device.

In addition, in at least one support loop member 30, the first section 31 is composed of a number of concentrically arranged second sections 33. A cross section of the second section 33 is also an arc structure. Inner diameters of the plurality of second sections 33 in the same first section 31 are the same, and the plurality of second sections 33 are arranged as a loop member at intervals. A second notch 34 is formed between two adjacent second sections 33. There is no need to provide a slot in the electrode 40, thereby improving the stiffness of the counter electrode 40.

In some embodiments, in four support loop members 30 close to the edge of the diaphragm, a first section 31 is composed of two concentrically arranged second sections 33. A second notch 34 is formed between the two second sections 33, and the second notch 34 is located in the middle of the first section 31. Those skilled in the art can understand that, the number and position of the second sections 33 included in a first section 31 may vary according to actual situations, which is not limited herein.

With reference to FIG. 1 and FIG. 2, the first notches 32 of two adjacent support loop members 30 are in one-to-one correspondence. Along the radial direction of the diaphragm 20, an arc lengths of the first notches 32 of support loop members 30 gradually increase, so that the adjacent first sections 31 have larger gap therebetween. The electrode 40 does not need slots at positions corresponding to first notches 32, thereby further increasing the stiffness of the electrode 40.

The arc length of the first notch 32 in the support loop members 30 may increase linearly, or may also increase non-linearly. That is, the arc length of the first notch 32 gradually changes from the center of the diaphragm 20 to the edge, and the gap between the first sections 31 is larger, which is beneficial to improve the stiffness of the counter electrode 40.

Figure 4:
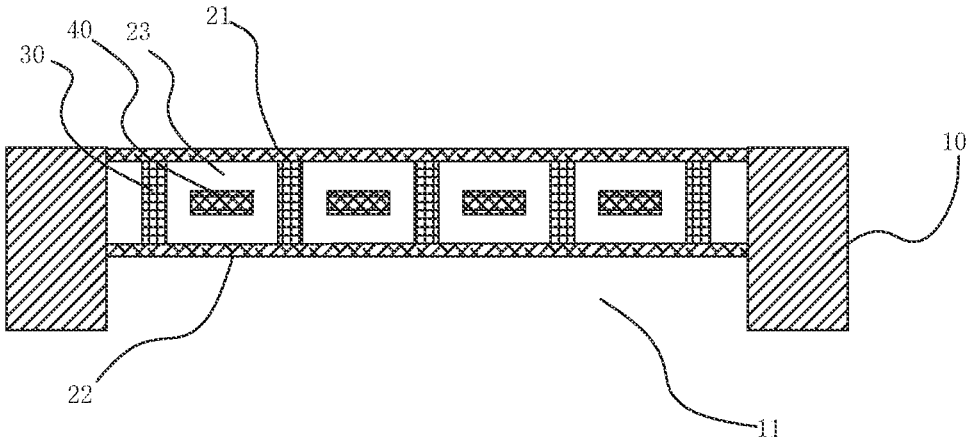
FIG. 4 is a cross-sectional view of a first diaphragm provided by the present disclosure.
Figure 5:
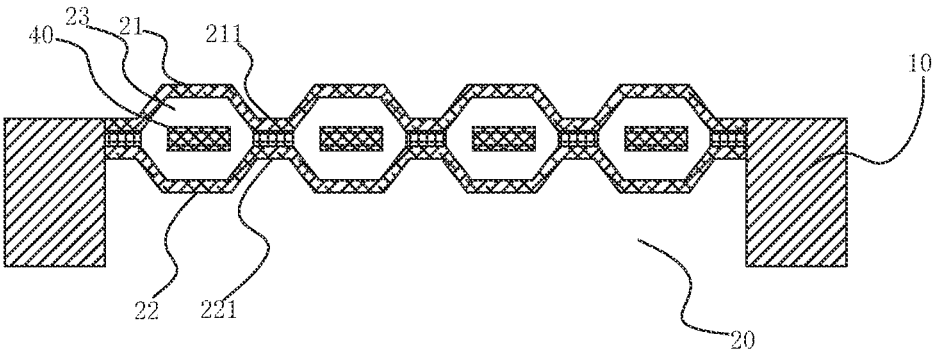
FIG. 5 is a cross-sectional view of a second diaphragm provided by the present disclosure.

Referring to FIG. 4 and FIG. 5, FIG. 4 is a cross-sectional view of a first diaphragm of the present disclosure, and FIG. 5 is a cross-sectional view of a second diaphragm of the present disclosure.

Referring to FIG. 4, in some embodiments, the first membrane 21 and the second membrane 22 are both planar structures.

Referring to FIG. 5, in some embodiments, the first membrane 21 and the second membrane 22 in the diaphragm 20 are both corrugated structures. The first membrane 21 includes a plurality of first protrusions 211 protruding toward the accommodating space 23, the second membrane 22 includes a plurality of second protrusions 221 protruding toward the accommodating space 23. The plurality of first protrusions 211 and the plurality of second protrusions 221 are respectively arranged at intervals along the radial direction of the diaphragm 20. The plurality of support loop members 30, the plurality of first protrusions 211, and the plurality of second protrusions 221 are in one-to-one correspondence. Opposite ends of the support loop member 30 are respectively connected to the first protrusions 211 and the second protrusion 221.

In an embodiment, the shapes and sizes of the first protrusions 211 and the second protrusions 221 are the same to form regular corrugations, so that the stress distribution on the entire diaphragm 20 is uniform and it is advantageous for the forming process. In addition, the cross-sectional shape of the first protrusion 211 and the second protrusion 221 in the direction perpendicular to the diaphragm 20 may be rectangular, trapezoidal, or triangular. An angle of the inclined surfaces of the first protrusion 211 and the second protrusion 221 is greater than 0° and less than or equal to 90°. Those skilled in the art can understand that, the cross-sectional shape of the first protrusion 211 and the second protrusion 221 in the direction perpendicular to the diaphragm 20 can be regular or irregular, which is not limited herein.

The first protrusion 211 and the second protrusion 221 together form the corrugation of the diaphragm 20, so that the diaphragm 20 can have greater tension and can withstand greater sound pressure. Moreover, the formed diaphragm 20 has a smaller size. The internal stress of the MEMS device 200 reduces the stiffness of the diaphragm 20, which effectively improves the mechanical sensitivity of the MEMS device 200.

In some embodiments, the accommodating space 23 is hermetically sealed, and the internal pressure of the accommodating space 23 is lower than the external atmospheric pressure. The internal pressure of the accommodating space 23 is less than 0.2 atm. For example, the pressure in the accommodating space 23 is equal to 0.1 atm. In some embodiments, the accommodating space 23 is vacuum.

Figure 6:
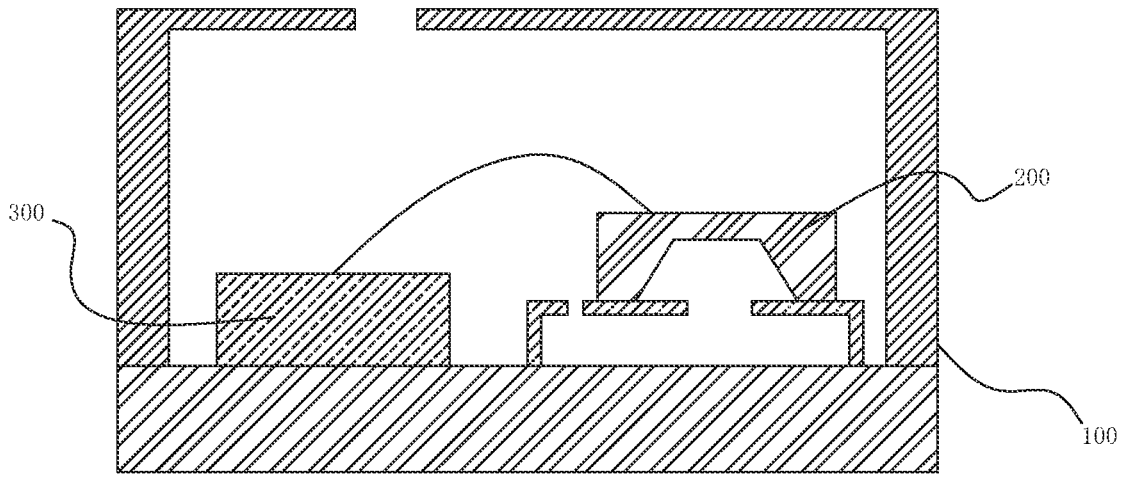
FIG. 6 is a schematic structural diagram of an electro-acoustic transducer provided by the present disclosure.

Based on the above embodiments, the present disclosure also provides an electro-acoustic transducer 100, with reference to FIG. 6, the FIG. 6 is a schematic view of the electro-acoustic transducer of the present disclosure. The electro-acoustic converter 100 includes the aforementioned MEMS device 200 and a circuit device 300 (ASIC) electrically connected to the MEMS device 200. The electro-acoustic transducer 100 may be a microphone, a speaker, or the like.

The structure, features, and effects of the present disclosure are described above in detail based on the embodiments shown in the drawings. The foregoing are only preferred embodiments of the present disclosure, but the present disclosure is not limited by implementation as shown in the drawings. Any changes made to the concept of the present disclosure, or equivalent embodiments modified into equivalent changes, which still do not exceed the spirit covered by the specification and drawings, shall fall within the protection scope of the present disclosure.

What is claimed is:

1. A micro electro mechanical system (MEMS) device, comprising:

a substrate having a back cavity passing through the substrate;

a diaphragm connected to the substrate and covers the back cavity, wherein the diaphragm comprises a first membrane and a second membrane arranged opposite to each other, and an accommodating space is formed between the first membrane and the second membrane;

a counter electrode arranged in the accommodating space; and a plurality of support loop members arranged concentrically in the accommodating space, wherein opposite ends of each of the plurality of support loop members along a vibration direction are respectively connected to the first membrane and the second membrane, and the plurality of support loop members are arranged at intervals along a radial direction of the diaphragm with a center of the diaphragm as the center, wherein each of the plurality of support loop members is composed of a plurality of first sections concentrically arranged, the plurality of first sections are arranged as a loop member at intervals, and a first notch is formed between two adjacent first sections of the plurality of first sections, and in at least one of the plurality of support loop members, the first section is composed of a plurality of second sections concentrically arranged, the plurality of second sections are arranged as a loop member at intervals, and a second notch is formed between two adjacent second sections of the plurality of second sections.

2. The MEMS device according to claim 1, wherein the plurality of first sections and the plurality of second sections each have an arc shape.

3. The MEMS device according to claim 1, wherein in each of four support loop members of the plurality of support loop members close to an edge of the diaphragm, the first arc section is composed of a plurality of second sections arranged concentrically.

4. The MEMS device according to claim 3, wherein the first section is composed of two second sections arranged concentrically.

5. The MEMS device according to claim 1, wherein positions of the first notches in two adjacent support loop members of the plurality of support loop members are in a one-to-one correspondence, and arc lengths of the first notches in the plurality of support loop members increase along the radial direction of the diaphragm.

6. The MEMS device according to claim 1, wherein the first membrane comprises a plurality of first protrusions protruding toward the accommodating space, and the second membrane comprises a plurality of second protrusions protruding toward the accommodating space, the plurality of first protrusions and the plurality of second protrusions are arranged at intervals along the radial direction of the diaphragm; the plurality of support loop members, the plurality of first protrusions and the plurality of second protrusions are in one-to-one correspondence, and opposite ends of the support loop member are respectively connected to one of the plurality of first protrusions and one of the plurality of second protrusions.

7. The MEMS device according to claim 1, wherein the first membrane and the second membrane both have a planar structure.

8. The MEMS device according to claim 1, wherein the accommodating space is hermetically sealed, and an internal pressure of the accommodating space is less than an external atmospheric pressure.

9. The MEMS device according to claim 1, wherein the first membrane and the second membrane are both made of a conductive material or comprise an insulation film having a conductive element.

10. The MEMS device according to claim 1, wherein the counter electrode comprises a single conductor, a first capacitor is formed between the first membrane and the single conductor, and a second capacitor is formed between the second membrane and the single conductor.

11. An electro-acoustic transducer, comprising a micro electro mechanical system (MEMS) device and a circuit device electrically connected to the MEMS device, wherein the MEMS comprises:

a substrate having a back cavity passing through the substrate;

a diaphragm connected to the substrate and covers the back cavity, wherein the diaphragm comprises a first membrane and a second membrane arranged opposite to each other, and an accommodating space is formed between the first membrane and the second membrane;

a counter electrode arranged in the accommodating space; and a plurality of support loop members arranged concentrically in the accommodating space, wherein opposite ends of each of the plurality of support loop members along a vibration direction are respectively connected to the first membrane and the second membrane, and the plurality of support loop members are arranged at intervals along a radial direction of the diaphragm with a center of the diaphragm as the center, wherein each of the plurality of support loop members is composed of a plurality of first sections concentrically arranged, the plurality of first sections are arranged as a loop member at intervals, and a first notch is formed between two adjacent first sections of the plurality of first sections, and in at least one of the plurality of support loop members, the first section is composed of a plurality of second sections concentrically arranged, the plurality of second sections are arranged as a loop member at intervals, and a second notch is formed between two adjacent second sections of the plurality of second sections.

* * * * *